US005497551A

United States Patent [19]

Apprille, Jr.

[11] Patent Number: 5,497,551

[45] Date of Patent: Mar. 12, 1996

[54] RAZOR HANDLE ASSEMBLY

[75] Inventor: Domenic V. Apprille, Jr., Arlington, Mass.

[73] Assignee: The Gillette Company, Boston, Mass.

[21] Appl. No.: 322,433

[22] Filed: Oct. 13, 1994

[51] Int. Cl.[6] ..... B26B 21/52

[52] U.S. Cl. ..... 30/85; 30/87

[58] Field of Search ..... 30/85–90, 340; 16/110 R, 116 R

[56] References Cited

U.S. PATENT DOCUMENTS

| | | | |
|---|---|---|---|
| D. 253,726 | 12/1979 | Schuman et al. | D28/46 |
| D. 253,727 | 12/1979 | Kowal | D28/46 |
| D. 304,773 | 11/1989 | Beuchat | D28/46 |
| 3,171,567 | 3/1965 | Somers et al. | 30/90 |
| 4,167,059 | 9/1979 | Iten | 30/32 |
| 4,272,886 | 6/1981 | Asano | 30/47 |
| 5,050,301 | 9/1991 | Apprille | 30/87 |
| 5,113,586 | 5/1992 | Lazarchik et al. | 30/90 |
| 5,157,835 | 10/1992 | Lazarchik et al. | 30/85 |

FOREIGN PATENT DOCUMENTS 2312334 12/1976 France .

*Primary Examiner*—Douglas D. Watts

*Attorney, Agent, or Firm*—Owen J. Meegan; Aubrey C. Brine; Donal B. Tobin

[57] ABSTRACT

A handle assembly for a safety razor comprises a grip portion formed of a pair of shells mounted on a substantially planar body member. The shell members cover only the periphery of the top and bottom surfaces of the body member which is fabricated of a first element formed of a substantially flexible elastomeric material and a second element formed of a more rigid material. The second element is sandwiched between the top and bottom surfaces of the first element, or imbedded within the first element by a molding process.

16 Claims, 4 Drawing Sheets

RAZOR HANDLE ASSEMBLY

BACKGROUND OF THE INVENTION

The present invention relates to wet shaving implements and more particularly to a razor handle assembly to which a blade assembly is attached during a shaving operation.

In U.S. Pat. No. 4,168,571, issued Sep. 25, 1979, and assigned to the assignee of the present invention, it has been suggested to employ a razor of the block type comprising a casing of a size and shape to be gripped in the palm of the hand as in the use of a conventional electric razor. However in that disclosed device a blade member is employed for use in a wet shaving process.

A similar type of razor is shown in U.S. Pat. No. 5,157,835, issued Oct. 27, 1992, and assigned to the assignee of the present invention, in which a novel razor handle assembly is disclosed to be employed with a razor for the wet shaving process. This disclosed structure has proved to be successful in achieving those objectives set forth in the patent, and has met with commercial success.

While the handle disclosed in U.S. Pat. No. 5,157,835 provides a substantially rigid gripping portion which is easy to manipulate, it is considered that an improvement could be obtained in the gripping portion of the handle, without compromise of the structural integrity of the device.

It is therefore an object of the present invention to provide a razor handle assembly of the type to be held with the fingers or in the palm of the hand which provides an improved grip over those devices disclosed in the prior art.

Another object of the invention is to provide a razor handle of the above type which employs a combination of materials offering an improved grip and better control than the devices of the prior art.

Yet another object of the invention is to provide a razor handle of the above type which provides a comfortable and pleasing grip to the user during the shaving operation.

SUMMARY OF THE INVENTION

The above objects and other objectives which will become apparent as the description proceeds are accomplished by providing a razor handle assembly comprising a substantially flat planar body member to be held in the fingers or palm during use. A top shell member is mounted on one surface of the body and a bottom shell member is mounted on the opposite surface, each of the shell members covering only the peripheral top and bottom surfaces of the body member. The body members comprise a first element which has an outer surface formed of substantially flexible material and a second element formed of a more rigid material than the first element. The second element is disposed beneath the surface of the first element for reinforcing the body member.

The razor handle may have a first element which is entirely formed of a substantially flexible material providing both the top and bottom body surfaces and in this case, the second element is sandwiched between the top and bottom surfaces of the first element.

The body member generally has a plurality of ribs extending from each of the body member top and bottom surfaces to provide a means for retention of the razor handle by the user, and the first element may be formed of a thermoplastic elastomer.

The second element forming the body may be formed of an ABS material or a styrene material, giving the body member a required rigidity.

The razor handle may further have the top shell member and the bottom shell member fastened one to the other by a plurality of substantially rigid pins which extend through the second element of the body member, in which case the more rigid material of the second element serves as bearing surface between the body member and the pins.

BRIEF DESCRIPTION OF THE DRAWING

The foregoing and other features of the invention will be more particularly described in connection with the preferred embodiment, and with reference to the accompanying drawing wherein.

DESCRIPTION OF THE PREFERRED EMBODIMENT

Figure 1:
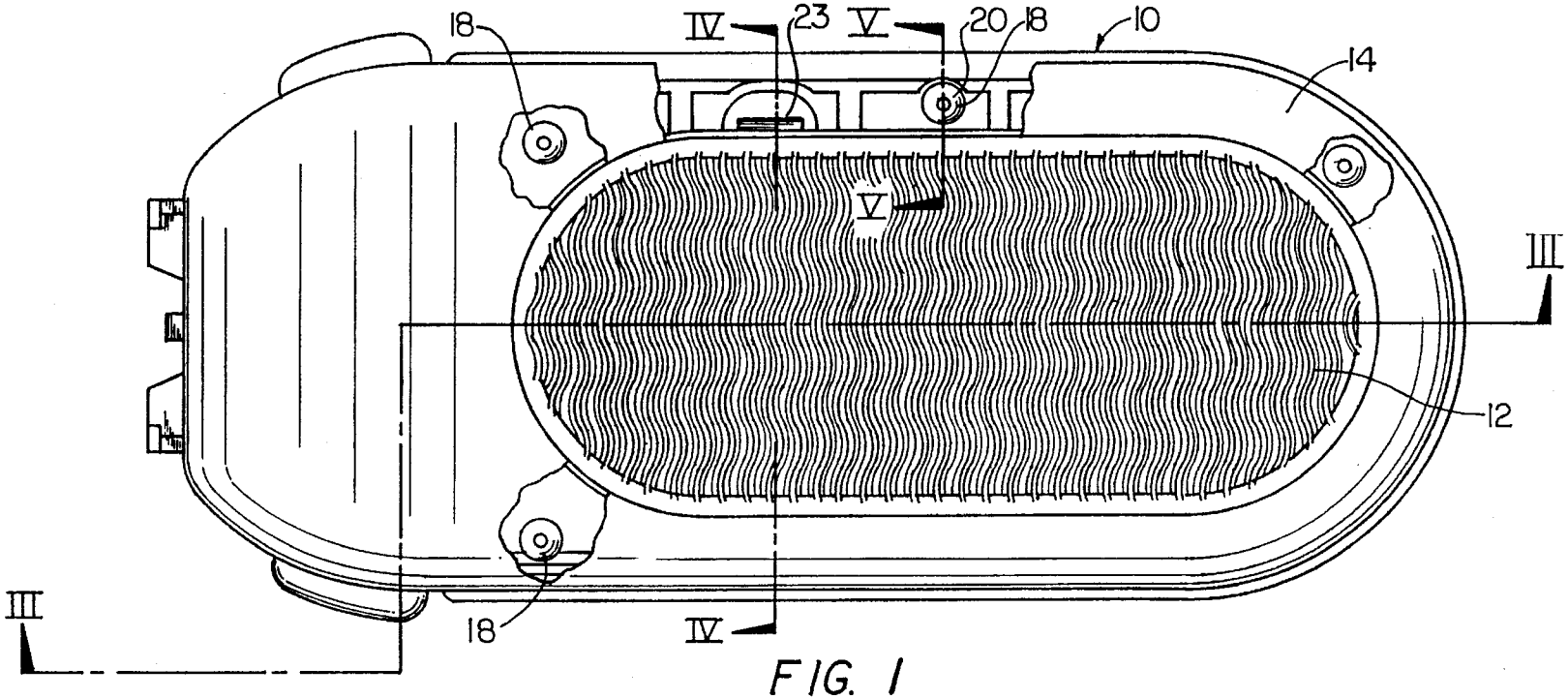
FIG. 1 is a top plan view showing a safety razor handle assembly constructed in accordance with the teachings of the present invention and having portions of the structure removed for clarity.
Figure 2:
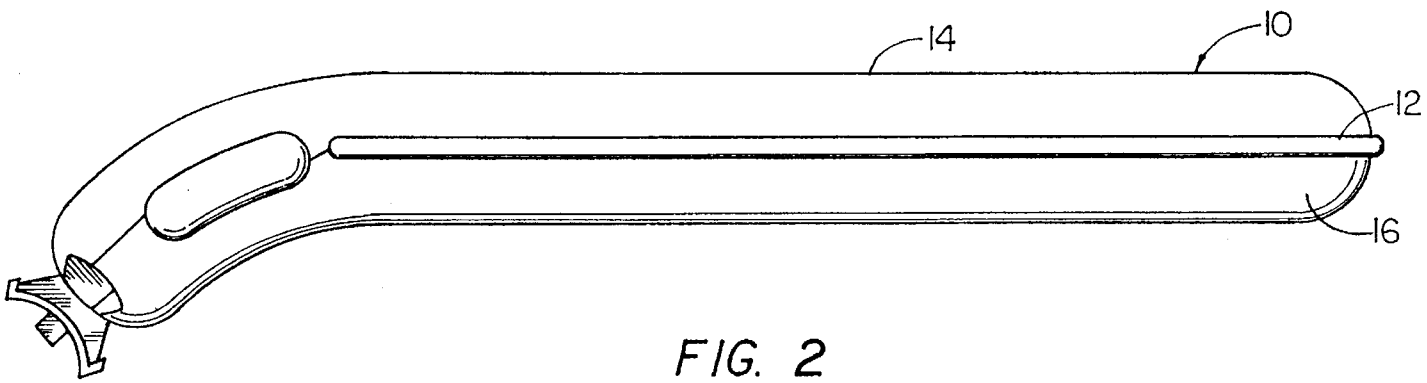
FIG. 2 is a side elevational view showing the structure of FIG. 1.
Figure 3:
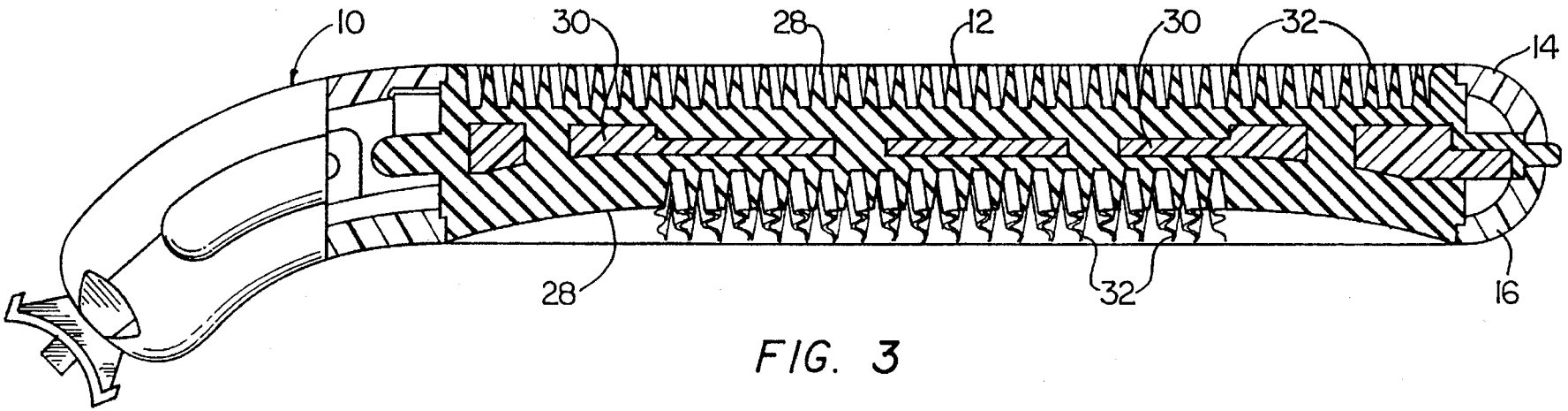
FIG. 3 is an elevational sectional view taken along the line III—III of FIG. 1 showing details of the razor handle assembly of FIGS. 1 and 2.
Figure 4:
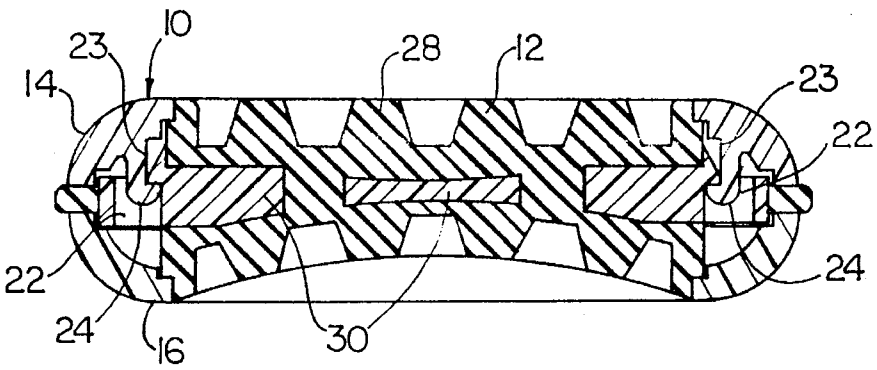
FIG. 4 is an elevational sectional view taken along the line IV—IV showing further details of the assembly.
Figure 5:
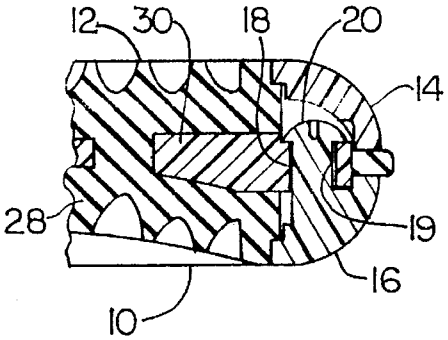
FIG. 5 is a fragmentary elevational sectional view taken along the line V—V of FIG. 1 showing details of a portion of the assembly of FIGS. 1 through 4.
Figure 6:
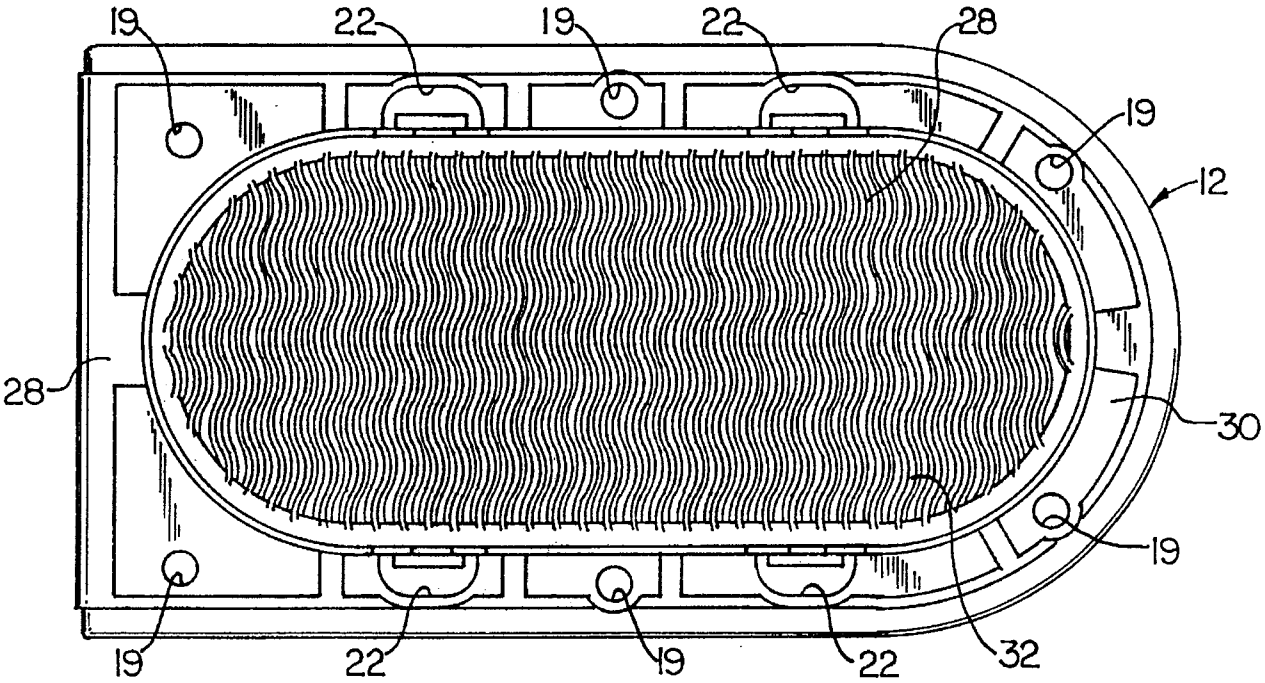
FIG. 6 is a top plan view showing the grip portion of the safety razor assembly of FIGS. 1 through 5, the grip portion having been removed from the assembly for clarity.
Figure 7:
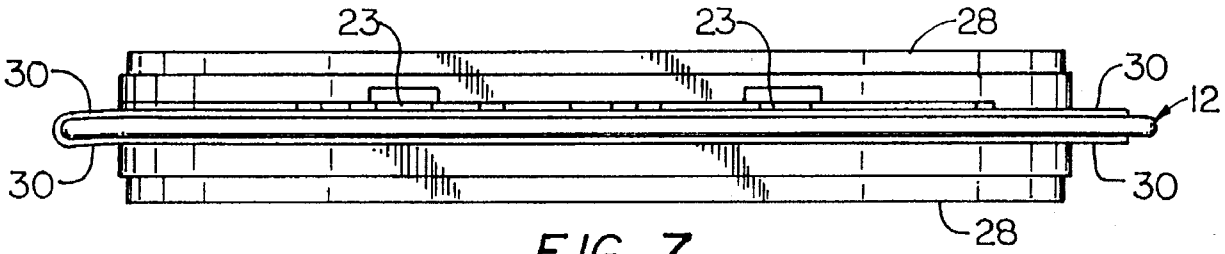
FIG. 7 is a side elevational view showing details of the structure of FIG. 6.
Figure 8:
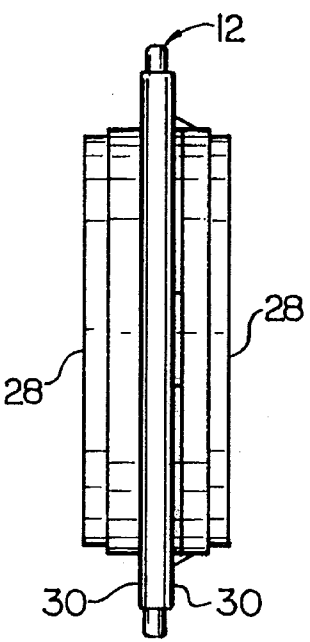
FIG. 8 is an end elevational view showing further details of the structure of FIGS. 6 and 7.

Referring to the drawing and in particular FIGS. 1 through 5 there is shown a safety razor handle assembly 10 comprising a substantially flat planar body member 12 having a top shell member 14 and a bottom shell member 16 mounted on opposite surfaces of the body member. The top shell member 14 and the bottom shell member 16 are each manufactured of a resilient plastic material such as ABS, and as best shown in FIG. 1 and FIG. 5, the bottom shell member 16 is provided with a plurality of upwardly projecting cylindrical pins 18 (six in number) which extend through an equal number of aligned circular openings 19 and the body member 12. With the body member 12 and the bottom shell member 16 assembled as shown in FIGS. 1 through 5, the upper portion of each of the pins 18 is formed to the configuration shown in FIG. 5 producing a head 20, locking the bottom shell member 16 and the body member 12 together.

Referring to FIG. 4, it will be noted that the body member 12 is further provided with a plurality of slots 22, each of the slots having an outwardly extending flange 23 located above, but in alignment with the slot 22. As best seen in FIG. 4, the top shell member 14 is provided with a plurality of downwardly protruding detents 24, one for each of the slots 22, each being aligned with a slot such that when the top shell member 14 is placed onto the assembled body member 12 and the bottom shell member 16, the detents 24 are snapped over the flanges 23 to secure the top shell member to the handle assembly 10.

As in the previously cited U.S. Pat. No. 5,157,835, with the top shell member 14 and bottom shell member 16 assembled on either side of the body member 12 the shell members extend only about the periphery of the body member 12. Further, as in the previously cited U.S. Pat. No. 5,157,835, top shell member 14 and the bottom shell member 16 extend beyond the body member 12 and are curved downwardly at an angle of about 45° with the body member 12. This portion of the combined shell members 14 and 16 form a substantially enclosed housing for housing a means for retaining a razor cartridge onto the handle assembly 10. The cartridge retaining means may be of the type described in detail in the aforementioned U.S. Pat. No. 5,157,835, or may be of any type known in the art which may be encased between the forward extending portions of the shell members 14 and 16. Since the cartridge retaining means and the elements thereof are described in one form in the previously recited reference, and may be of a different type or design, such a device will not be described herein as it is considered to form no part of the present invention.

Referring now to FIGS. 6 through 10 taken in conjunction with the previously described FIGS. 1 through 5, the body member 12 is shown to be comprised of a pair of substantially planar elements, a relatively soft thermoplastic elastomer grip member 28 and a more rigid reinforcing member 30, encased within the grip member.

The grip member 28 is generally manufactured of a thermoplastic elastomer which is relatively soft having a durometer of between 40 and 60 measured on the Shore A40 to Shore A60 scale. The grip member 28 further is provided with a plurality of waved fins 32 which extend outwardly from both the top and bottom surface of the member 28. The top and bottom surfaces of the grip member 28 may both be planar or both be concave. In the present embodiment the grip member has been constructed with one planar surface and one slightly concave surface as shown in FIGS. 3 and 4.

In general, the height of the fins 32 and their thickness when combined with the relatively soft material chosen for the grip member 28, provide a structure wherein the tips of the fins may be flexed in the longitudinal direction of the body member 12 giving the user a more substantial grip onto the razor, and therefore providing more control when moving the razor over the portion to be shaved. While the grip member 28 may be manufactured of any thermoplastic elastomer having the required softness, in the present embodiment the material employed is a translucent material sold under the name of Kraton 2712 which is a trademark of Shell Corporation.

Figure 9:
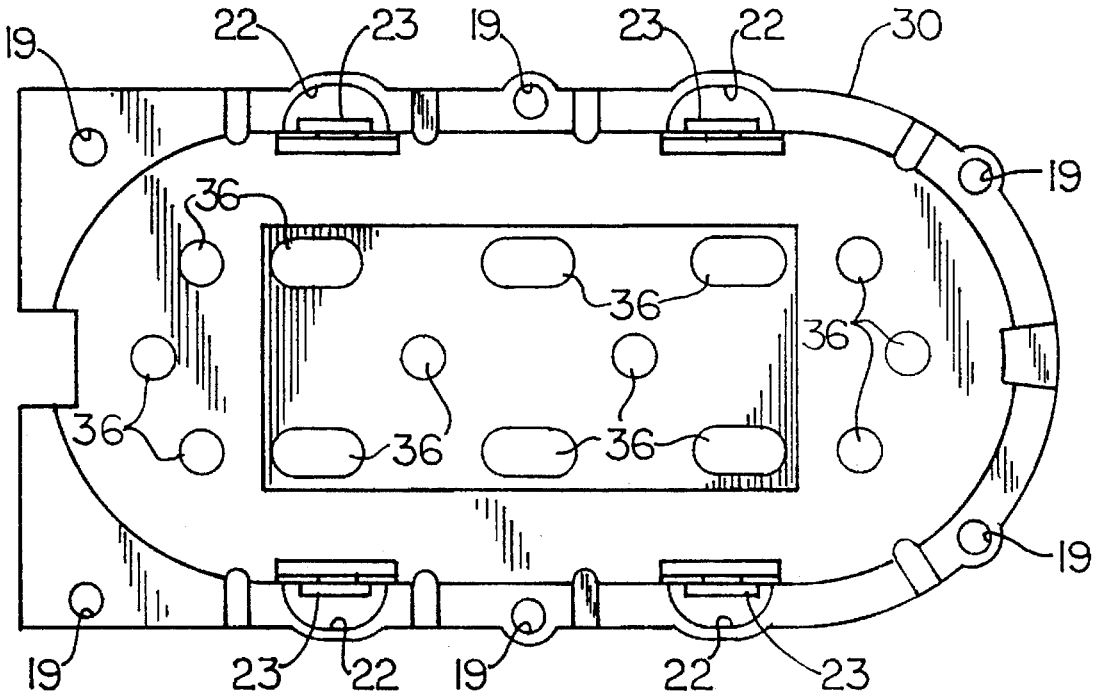
FIG. 9 is a top plan view showing details of an element of the structure of FIGS. 6, 7 and 8.
Figure 10:
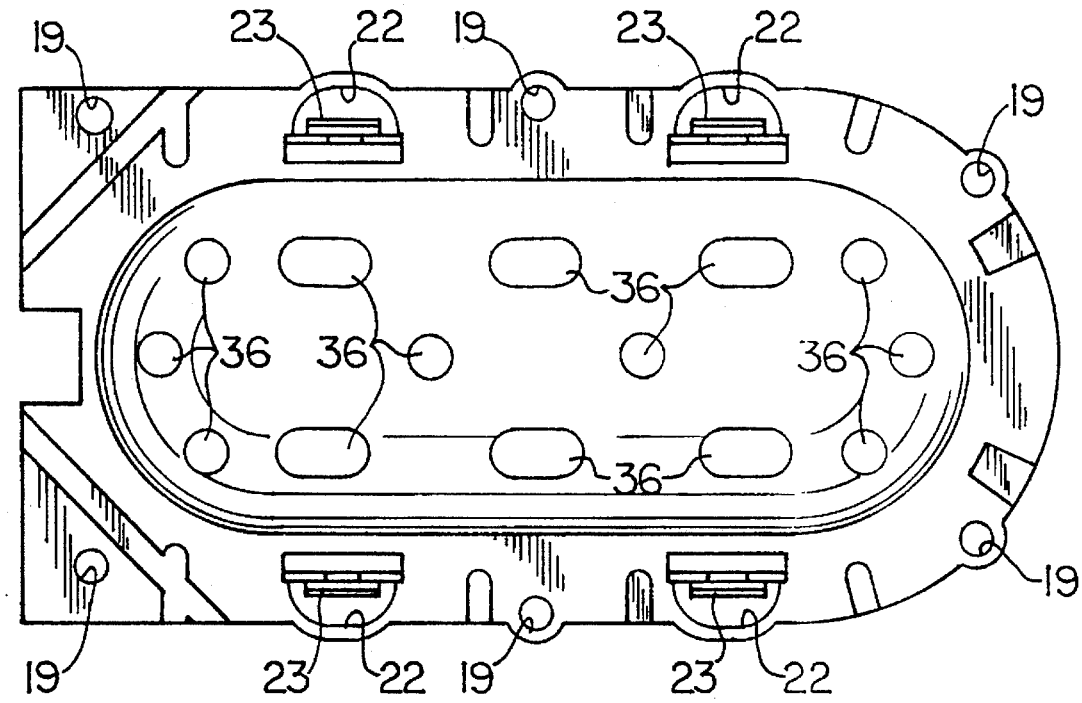
FIG. 10 is a bottom plan view showing further details of the element of FIG. 9.

Referring particularly to FIGS. 9 and 10 it will be observed that the reinforcing member 30 is sandwiched between the upper and lower surfaces of the grip member 28, and preferably is imbedded within the grip member. The reinforcing member 30 may be manufactured of an ABS material or styrene and is generally considered to be a rigid material when compared with that of the grip member 28. The formation of the body member 12 from the grip member 28 and reinforcing member 30 may be accomplished by an insert molding process, or any process in which the thermoplastic elastomer is molded onto the more rigid material to project through the openings 36 in the reinforcing member, as best shown in FIGS. 9 and 10.

Referring still to FIGS. 9 and 10, it will be noted that each of the fastening points which fasten the top shell 14, bottom shell 16, and the body member 12 together, are provided by the reinforcing member 30. The openings 19 are produced in the reinforcing member 30 for receiving and retaining the pins 18 and the flanges 23 are formed on the reinforcing member for retaining the detents 24.

From the foregoing it should therefore be evident that while the body member 12 provides a substantially soft surface to be gripped by the user, the employment of the reinforcing member 30 insures that the body member 12 does not collapse at its center when so gripped. Further, as the pins 18 are provided with bearing surface both in the planar direction and axially under the heads 20 of the pins, the rigidity of the reinforcing member 30 ensures that the parts may be snapped together and solidly connected by employing the rigid flange 23 of the reinforcing member 30 with the detents 24 provided on the top shell 14.

While it is apparent that changes and modifications can be made within the spirit and scope of the present invention, it is my intention, however, only to be limited by the scope of the appended claims.

As my invention I claim:

1. A razor handle assembly comprising:

a substantially flat planar body member to be held in the fingers or palm during use, a top shell member mounted on one surface thereof and a bottom shell member mounted on the opposite surface thereof, each of said shell members covering only the peripheral top and bottom surface of said body member;

said body member comprising a first element formed of substantially flexible material and a second element formed of a more rigid material than said first element, said first element being formed in its entirety of said substantially flexible material providing a top surface and a bottom surface of said body member and said second element being sandwiched within said first element between said top and bottom surfaces and forming said peripheral top and bottom surface of said body member contacting and covered by said shell members, said first element having a plurality of fins extending from each of said top and bottom surfaces, and each said fin having a flexible tip, said fins thereby providing a means for retention of the razor handle by the user.

2. A razor handle as set forth in claim 1 wherein said first element of said body member is formed of a thermoplastic elastomer.

3. A razor handle as set forth in claim 1 wherein said second element of said body member is formed of an ABS material.

4. A razor handle as set forth in claim 1 wherein said second element of said body member is formed of a styrene material.

5. A razor handle as set forth in claim 1 wherein said top shell member and said bottom shell member each have a portion extending forwardly beyond said body member and attached one to the other to form a substantially enclosed housing therebetween.

6. A razor handle as set forth in claim 5 wherein said forwardly extending portions of said shells forming said housing extend downwardly to form an angle with said body member.

7. A razor handle as set forth in claim 1 wherein said first element of said body member is formed of a relatively soft elastomeric material having a durometer in the area of between 40 and 60 measured on the Shore A40 to Shore A60 scale.

8. A razor handle as set forth in claim 1 wherein said top shell member and said bottom shell member are fastened one to the other by a plurality of substantially rigid pins extending through the second element of said body member.

9. A razor handle as set forth in claim 2 wherein said first element of said body member is formed of a relatively soft elastomeric material having a durometer in the area of between 40 and 60 measured on the Shore A40 to Shore A60 scale.

10. A razor handle as set forth in claim 9 wherein said top shell member and said bottom shell members are fastened one to the other by a plurality of substantially rigid pins extending through the second element of said body member.

11. A razor handle as set forth in claim 10 wherein said second element of said body member is formed of an ABS material.

12. A razor handle as set forth in claim 13 wherein said second element of said body member is formed of a styrene material.

13. A razor handle as set forth in claim 11 wherein said top shell member and said bottom shell member each have a portion extending forwardly beyond said body member and attached one to the other to form a substantially enclosed housing therebetween.

14. A razor handle as set forth in claim 13 wherein said forwardly extending portions of said shells forming said housing extend downwardly to form an angle with said body member.

15. A razor handle as set forth in claim 1 wherein a said shell member is provided with a plurality of depending detents, said second element is provided with a plurality of apertures and a plurality of flanges in registry with and partially occluding said apertures, whereby said detents are at least partially received in said apertures and retainedly engaged by said flanges.

16. A razor handle as set forth in claim 1 wherein said second element of said body member is provided with a plurality of apertures and said first element is molded to said second element through said apertures.

* * * * *